US012227886B2

(12) United States Patent
Opietnik et al.

(10) Patent No.: US 12,227,886 B2
(45) **Date of Patent: *Feb. 18, 2025**

(54) LYOCELL FIBER WITH VISCOSE LIKE PROPERTIES

(71) Applicant: LENZING AKTIENGESELLSCHAFT, 4860 Lenzing (AT)

(72) Inventors: Martina Opietnik, 4861 Schörfling am Attersee (AT); Verena Silbermann, 4851 Gampern (AT); Andrea Borgards, 4853 Steinbach am Attersee (AT)

(73) Assignee: Lenzing Aktiengesellschaft, Lenzing (AT)

( * ) Notice: Subject to any disclaimer, the term of this patent is extended or adjusted under 35 U.S.C. 154(b) by 1136 days.

This patent is subject to a terminal disclaimer.

(21) Appl. No.: 16/978,263

(22) PCT Filed: Mar. 6, 2019

(86) PCT No.: PCT/EP2019/055528
§ 371 (c)(1),
(2) Date: Sep. 4, 2020

(87) PCT Pub. No.: WO2019/170723
PCT Pub. Date: Sep. 12, 2019

(65) Prior Publication Data

US 2021/0002802 A1 Jan. 7, 2021

(30) Foreign Application Priority Data

Mar. 6, 2018 (EP) ..... 18160142

(51) Int. Cl.
*D04H 3/013* (2012.01)
*D01D 5/06* (2006.01)
(Continued)

(52) U.S. Cl.
CPC ..... *D04H 3/013* (2013.01); *D01D 5/06* (2013.01); *D01F 1/02* (2013.01); *D01F 2/08* (2013.01); *D10B 2201/24* (2013.01)

(58) Field of Classification Search
None
See application file for complete search history.

(56) References Cited

U.S. PATENT DOCUMENTS 4,246,221 A 1/1981 McCorsley, III
5,216,144 A 6/1993 Eichinger et al.
(Continued)

FOREIGN PATENT DOCUMENTS

AT 515693 A4 11/2015
CN 105442143 A 3/2016
(Continued)

OTHER PUBLICATIONS

BISFA (The International Bureau for the Standardization of Man-Made Fibers) publication, "Terminology of Man-Made Fibers", 2009 edition.
(Continued)

*Primary Examiner* — Arti Singh-Pandey
(74) *Attorney, Agent, or Firm* — Venable LLP

(57) ABSTRACT

The present invention provides a lyocell fiber with increased water retention value and decreased crystallinity as well as a method for producing same and products comprising same.

22 Claims, 5 Drawing Sheets

Fibrillation dynamics of three types of fibers.

(51) Int. Cl.
*D01F 1/02* (2006.01)
*D01F 2/08* (2006.01)

(56) References Cited

U.S. PATENT DOCUMENTS

| | | | |
|---|---|---|---|
| 5,413,631 | A | 5/1995 | Gray et al. |
| 5,456,748 | A | 10/1995 | Quigley et al. |
| 5,589,125 | A | 12/1996 | Zikeli et al. |
| 5,656,224 | A | 8/1997 | Zikeli et al. |
| 5,921,675 | A | 7/1999 | Zikeli et al. |
| 5,968,434 | A | 10/1999 | Zikeli et al. |
| 6,042,769 | A | 3/2000 | Gannon et al. |
| 6,183,865 | B1 | 2/2001 | Yabuki et al. |
| 6,440,547 | B1 | 8/2002 | Luo et al. |
| 6,527,987 | B1 | 3/2003 | Yabuki et al. |
| 6,706,237 | B2 | 3/2004 | Luo et al. |
| 8,420,004 | B2 | 4/2013 | Chou et al. |
| 8,802,229 | B2 | 8/2014 | Luo |
| 9,670,596 | B2 | 6/2017 | Kodie et al. |
| 10,370,778 | B2 | 8/2019 | Sperger |
| 10,570,565 | B2 | 2/2020 | Männer et al. |
| 2002/0060382 | A1 | 5/2002 | Luo et al. |
| 2011/0154627 | A1 | 6/2011 | Chou et al. |
| 2015/0148458 | A1 | 5/2015 | Koide et al. |
| 2017/0241079 | A1 | 8/2017 | Männer et al. |
| 2018/0002836 | A1 | 1/2018 | Sperger |
| 2021/0010163 | A1* | 1/2021 | Opietnik ..... D04H 3/013 |

FOREIGN PATENT DOCUMENTS

| | | | |
|---|---|---|---|
| EP | 0 952 243 | A1 | 10/1999 |
| EP | 2 853 624 | A1 | 4/2015 |
| ES | 2710616 | T3 | 4/2019 |
| KR | 2013-0096812 | A | 9/2013 |
| WO | 93/19230 | A1 | 9/1993 |
| WO | 94/28214 | A1 | 12/1994 |
| WO | 94/28217 | A1 | 12/1994 |
| WO | 96/33221 | A1 | 10/1996 |
| WO | 96/33934 | A1 | 10/1996 |
| WO | 98/05702 | A1 | 2/1998 |
| WO | 98/22642 | A1 | 5/1998 |
| WO | 2009/006207 | A1 | 1/2009 |
| WO | 2013/176138 | A1 | 11/2013 |

OTHER PUBLICATIONS

Wendler et al., "Polysaccharide Blend Fibres Formed from NaOH, N-Methylmorpholine-N-oxide and 1-Ethyl-3-methylimidazolium acetate", Fibers and Textiles in Eastern Europe, vol. 18, pp. 21-30 (2010).
Zhang et al., "Influence of hemicelluloses on the structure and properties of Lyocell fibers", Polymer Engineering and Science, vol. 47, pp. 702-706 (2007).
Zhang et al. "Comparison of the structures and properties of Lyocell fibers from high hemicellulose pulp and high a-cellulose pulp", Journal of Applied Polymer Science, vol. 107, pp. 636-641 (2008).
Zhang et al., "Effect of Hemicelluloses on the Structure and Properties of Lyocell Fibers", Polymer Materials Science and Engineering, vol. 24, pp. 99-102 (2008).
Zhang et al., "Preparation of Lyocell fiber from high hemicellulose pulp", China Synthetic Fiber Industry, vol. 31, pp. 24-27 (2008).
Zhang et al., "Effect of Oligosaccharide Accumulated in the Coagulation Bath on the Lyocell Fiber Process During Industrial Production", Journal of Applied Science, vol. 113, pp. 150-156 (2009).
Asaadia et al., "Structural analysis of loncell-F fibers from birch wood", Carbohydrate Polymers, vol. 181, pp. 893-901 (2018).
Schild et al., "Xylan Enriched Viscose Fibers", Cellulose, vol. 21, pp. 3031-3039 (2014).
Singh et al., "Study of cellulosic fibres morphological features and their modifications using hemicelluloses", Cellulose, vol. 24, pp. 3119-3130 (2017).
Abu-Rous et al., "A New Method to Visualize and Characterize the Pore Structure of TENCEL® (Lyocell) and Other Man-Made Cellulosic Fibres Using a Fluorescent Dye Molecular Probe," Journal of Applied Polymer Science, vol. 106, pp. 2083-2091 (2007).
Sjöberg et al., "Cross-Sectional Analysis of the Polysaccharide Composition in Cellulosic Fiber Materials by Enzymatic Peeling/High-Performance Capillary Zone Electrophoresis," Biomacromolecules, vol. 6, pp. 3146-3151 (2005).
Wendler et al., "Morphology of Polysaccharide Blend Fibers Shaped from NaOH, N-methylmorpholine-N-oxide and 1-ethyl-3-methylimidazolium Acetate," Cellulose, vol. 18, pp. 1165-1178 (2011).
Bartsch et al., "What Opportunities are Available to the Finisher From Today's Point of View When it Comes to Dyeing and Finishing of Lenzing Lyocell," Lenzinger Berichte, vol. 80, pp. 40-48 (2001).
Kayseri et al., "Performance Properties of Regenerated Cellulose Fibers," Tekstil ve Konfeksiyon, vol. 3, pp. 208-212 (2010).

* cited by examiner

Figures:
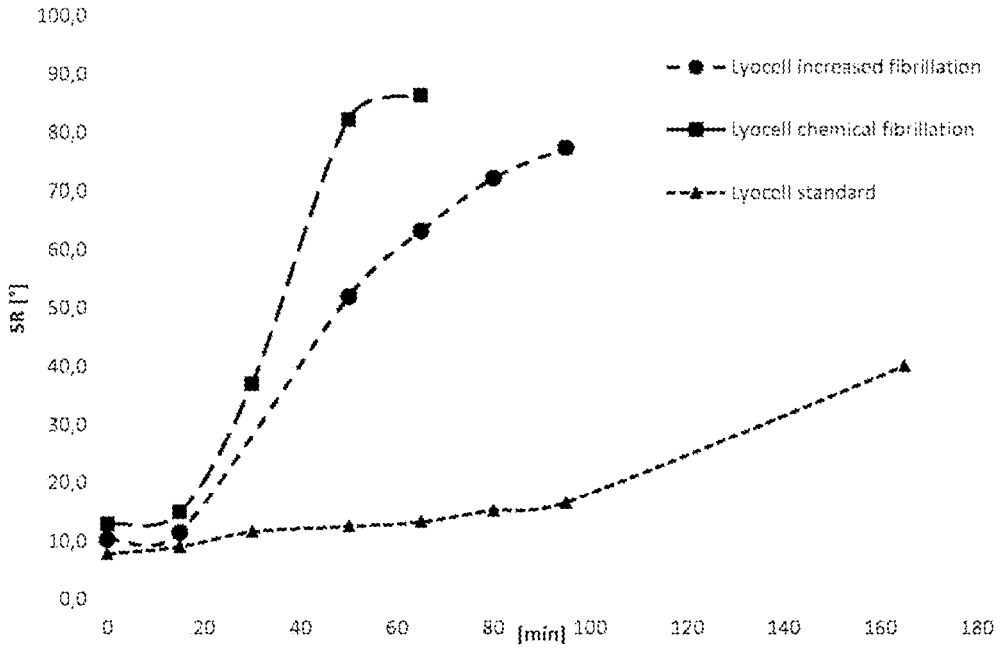
Figure 1: Fibrillation dynamics of three types of fibers.

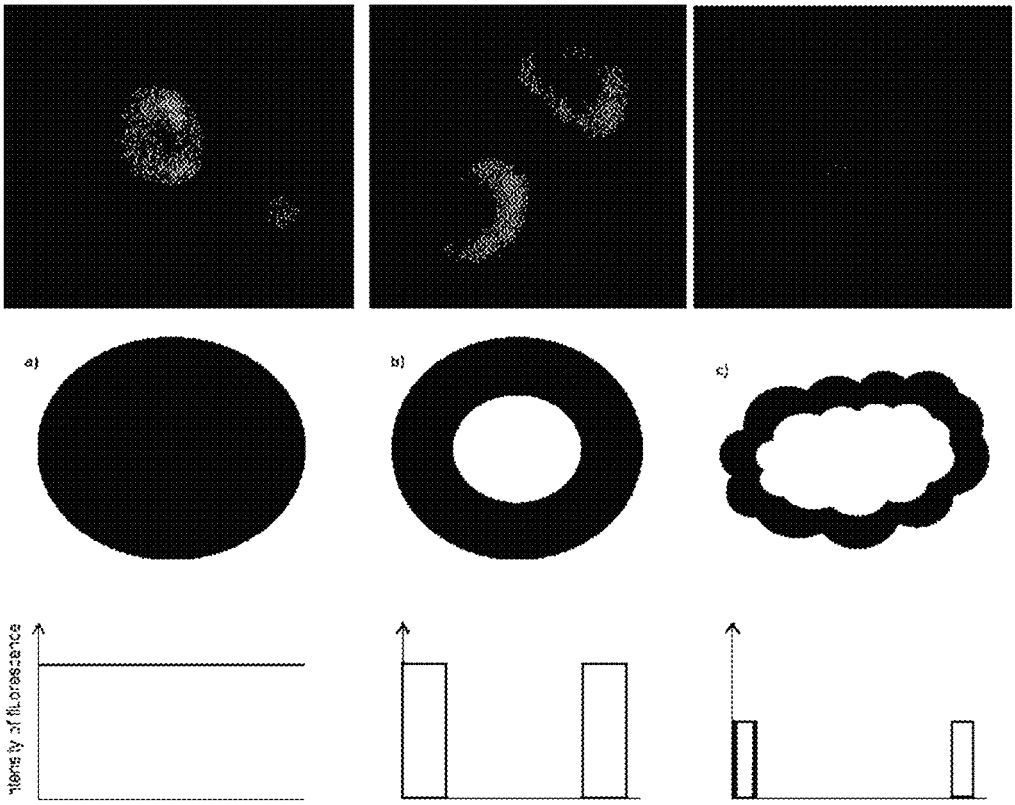
Figure 2: Fibers after fluorescent staining at maximum dye uptake a) fiber in accordance with present invention b) standard lyocell fiber c) standard viscose fiber and a schematic drawing of the intensity of the fluorescence of the tested fiber types

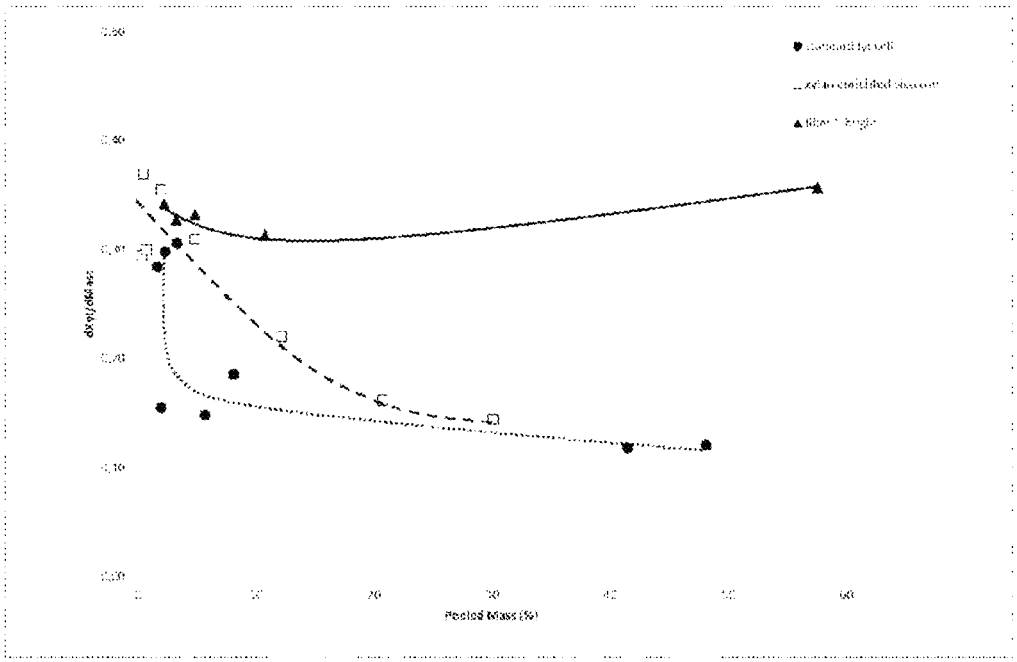
Figure 3: Xylan concentration over the fiber cross section of the new lyocell fiber with increased porosity compared to a standard lyocell fiber and a xylan enriched viscose fiber.
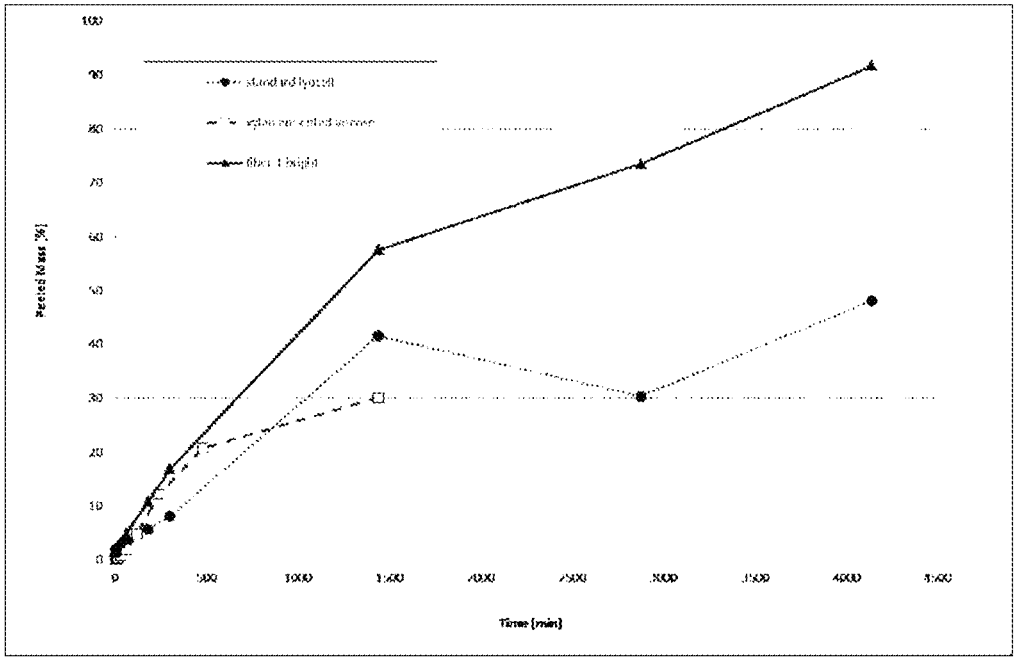
Figure 4: Velocity of enzymatic peeling for the new lyocell fiber with increased porosity compared to a standard lyocell fiber and a xylan enriched viscose fiber.

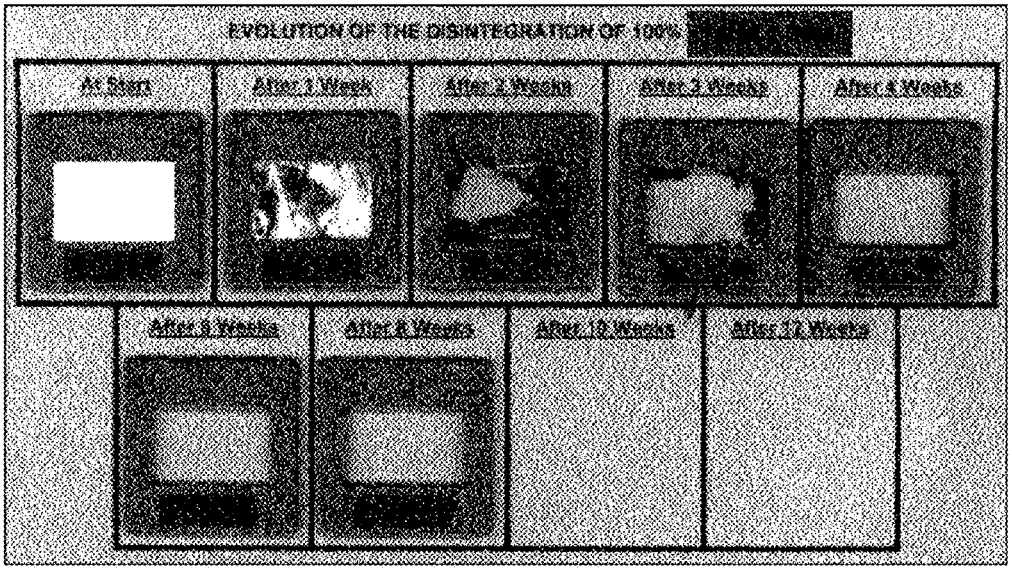
Figure 5. Visual presentation of the evolution of the disintegration of test material 100% fiber 1 dull in slide frames during the composting process.
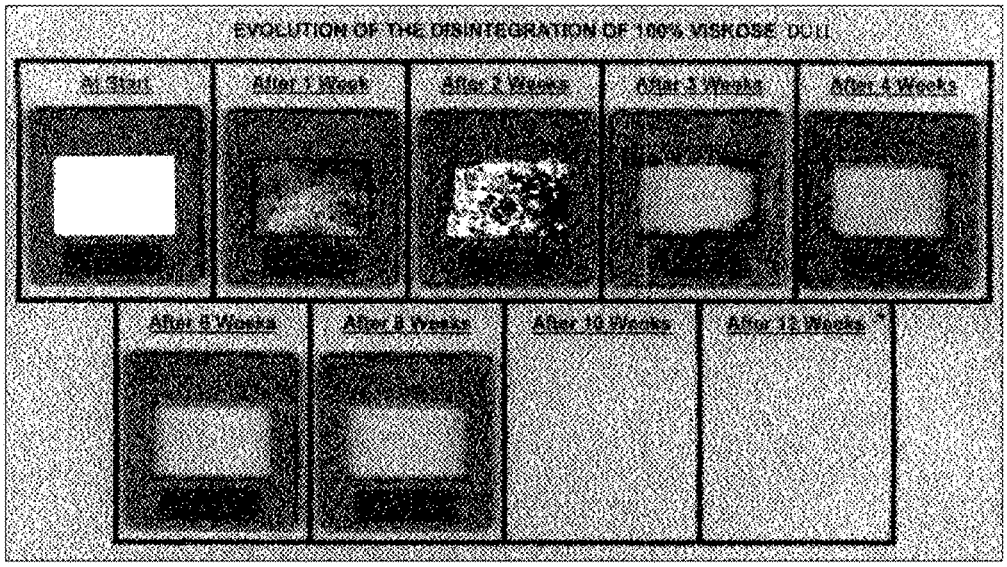
Figure 6. Visual presentation of the evolution of the disintegration of test material 100% viscose dull in slide frames during the composting process.

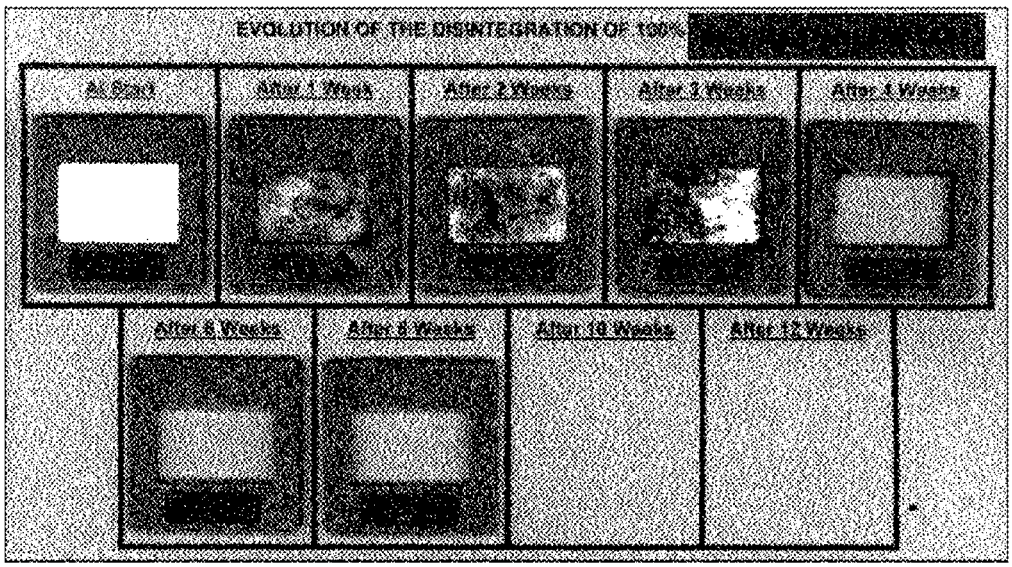
Figure 7. Visual presentation of the evolution of the disintegration of test material 100% standard lyocell dull in slide frames during the composting process.

LYOCELL FIBER WITH VISCOSE LIKE PROPERTIES

The present application is a national-stage entry under 35 U.S.C. § 371 of International Patent Application No. PCT/EP2019/055528, published as WO 2019/170723 A1, filed Mar. 6, 2019, which claims priority to EP 18160142.8 filed Mar. 6, 2018, the entire disclosure of each of which is hereby incorporated by reference.

BACKGROUND OF THE INVENTION

Field of the Invention

The present invention relates to a lyocell fiber with viscose like properties, a method for producing same as well as to products comprising the lyocell fiber.

State of the Art

Cellulose based fibers are employed in a wide variety of applications. Due to ever increasing demands even for such fibers based on renewable resources such as wood attempts have been made to increase the variety of raw materials which may be employed for the production of such fibers. At the same time a demand exists towards a further functionalization of such fibers, targeting specific fiber properties. Another aim is to mimic properties and structure of natural fibers. Fibers based on cellulose regeneration differ in their structure from natural fibers in that they typically do not show any internal cavities/lumen. For example, viscose fibers do show an oval cross section comprising a dense sheath and a sponge like core of the fiber. Lyocell fibers on the other hand do show a circular cross section with a three layered structure, comprising an outer compact skin with a thickness of 100 to 150 nm and a small pore size of from 2 to 5 nm, followed by a middle layer with increasing porosity and a dense, non-porous core.

The process for preparing lyocell fibers offers only limited options to influence fiber properties and structure. However, it would be advantageous if means existed to influence fiber properties to a greater extend even in the lyocell process. One option would be to either add additives, which is in particular broadly possible during viscose processes, or to employ by-products of the cellulose production in order to further vary the structure and/or properties of lyocell fibers.

It is for example known that chemical pre-treatment may influence fiber properties. U.S. Pat. No. 6,042,769 shows an example of chemical treatments to enhance fibrillation tendency. It discloses chemical treatments to reduce the DP (degree of polymerization) by 200 units, thereby increasing fibrillation tendency. Chemical treatments mentioned in this patent refer to the use of bleaching reagents, such as sodium hypochlorite or mineral acids, such as hydrochloric acid, sulfuric acid or nitric acid. A commercialization of this procedure did not succeed up to now.

U.S. Pat. No. 6,706,237 discloses that meltblown fibers obtained from hemicelluloses rich pulps show a decreased or reduced tendency to fibrillate. A similar disclosure is also given in U.S. Pat. No. 6,440,547, which again refers to meltblown fibers. For these as well as centrifugal fibers also crystallinity was determined, showing a rather insignificant decrease of crystallinity for the meltblown fibers with high hemicelluloses content as compared to standard lyocell fibers (decrease of less than 5%). U.S. Pat. No. 8,420,004 discloses another example of meltblown fibers for producing non-woven fabrics.

For viscose fibers it has been shown that the addition of hemicelluloses enables the modification of fiber properties. However, these modifications were always accompanied by a decrease of other important fiber properties, such as tenacity. However, such modifications, due to the differences in fiber production cannot be applied without problems to lyocell fibers.

Zhang et al (Polymer Engineering and Science 2007, 47, 702-706) describe lyocell fibers with higher hemicellulose contents. The authors postulate that the fibers tend to show an enhanced fiber fibrillation resistance, lower crystallinity and better dyeability. However, the determination of crystallinity in this paper showed an only insignificant decrease (less than 5%). They also postulate that the tensile strength only decreases insignificantly and that the fiber properties could be even increased further by higher hemicelluloses concentrations in the spinning dope. Zhang et al (Journal of Applied Polymer Science 2008, 107, 636-641), Zhang et al (Polymer Materials Science and Engineering 2008, 24, 11, 99-102) disclose the same figures as the paper by Zhang (Polymer Engineering and Science 2007, 47, 702-706), while Zhang et al (China Synthetic Fiber Industry 2008, 31, 2, 24-27) describe better mechanical properties for 2.3 dtex fibers. The same authors postulate this same theory in Journal of Applied Science 2009, 113, 150-156.

The fibers described in the paper by Zhang (Polymer Engineering and Science 2007, 47, 702-706) et al. are produced with lab equipment not allowing the production of lyocell fibers in commercial quality (as for example drawing ratios, production velocities and after-treatment do not reflect scale-up qualities). The fibers, not being produced with sufficient drawing and a sufficient after-treatment therefore can be expected to show different structures and properties compared to the fibers produced at production (semi)-commercial scale. In addition, no information is provided in the paper concerning the distribution of the hemicelluloses over the cross section of the lyocell fibers.

S. Singh et al. disclose in Cellulose (2017) 24:3119-3130 a Study of cellulosic fibers morphological features and their modifications using hemicelluloses. US 2002/0060382 A1 discloses a process of making lyocell fibers. Crystallinity of fibers disclose in US 2002/0060382 A1 are in the range of about 70% and the starting spinning compositions has a cellulose content of about 32 wt.-%.

In this regard it is known for viscose fibers that an increase in hemicellose content leads to an enrichment of the hemicelluloses content at the surface of the fiber, with a rapid decrease of the hemicelluloses content towards the core of the fiber. Similar distributions of hemicelluloses contents are known for standard lyocell fibers produced from high purity cellulose raw materials.

Wendler et al (Fibers and textiles in Eastern Europe 2010, 18, 2 (79), 21-30) and Wendler et al (Cellulose 2011, 18, 1165-1178) describe the addition of different polysaccharides (xylans, mannans, xylan derivative, . . . ) into lyocell dopes (NMMO, ionic liquids, NaOH) and subsequent analysis of the fibers. Disclosed are the water retention values of the fibers which show only an insignificant increase of the WRV with the addition of xylans in NMMO-based dopes. It is suspected that the fibers act differently produced by addition of polysaccharides into the dope or direct dissolution of a hemi-rich pulp. The fibers from both publications were produced at a self-made lab equipment not reflecting (semi)-commercial scale production conditions.

Schild et al (Cellulose 2014, 21, 3031-3039) describe xylan-enriched viscose fibers, wherein the xylan is added in a late step in the viscose production process. The authors investigated the distribution of the xylan over the cross-section of the fiber and detect an enrichment of the xylan in the outer layers of the fiber. Also, an increased water uptake was observed. Singh et al (Cellulose 2017, 24, 3119-3130) also describe the addition of hemicelluloses to the viscose process. They postulate that the fiber properties stay unaffected by this addition. Lyocell fibers are mentioned as reference fibers but no addition of xylan is described.

While viscose fibers are employed in a broad variety of applications the specific requirements for the production of viscose as well as some properties of viscose fibers, such as a distinct but undesired sulfuric smell due to its production process, are detrimental for wider applications.

OBJECT OF THE PRESENT INVENTION

In view of the increasing demands for fibers based on cellulose raw materials and in view of the above identified drawbacks of the viscose process it is the object of the present invention to provide non-viscose cellulose-based fibers with viscose like properties. Viscose like properties in the sense of the present invention are high-water retention values (WRV).

BRIEF DESCRIPTION OF THE INVENTION

The present inventors accordingly provide the fiber as defined in claim 1, the method for producing same as described in claim 11 as well as products containing same as defined in claim 13. Preferred embodiments are described in the respective subclaims as well as in the specification.

In particular the present invention provides the following embodiments, which are to be understood as being embodiments for which further explanations are provided below.

1) Lyocell fiber with a water retention value (WRV) of at least 70% and a crystallinity of 40% or less.
2) Lyocell fiber according to embodiment 1, having a titer of 6.7 dtex or less, preferably 2.2 dtex or less, even more preferably 1.3 dtex or less.
3) Lyocell fiber according to embodiment 1 and/or 2, produced from a pulp having a hemicelluloses content of 7 wt.-% or more and 25 wt.-% or less.
4) Lyocell fiber according to any one of the preceding embodiments, wherein the hemicellulose comprises a ratio of xylan to mannan hemicelluloses of from 125:1 to 1:3, such as 25:1 to 1:2.
5) Lyocell fiber according to any one of the preceding embodiments, wherein the pulp employed for preparing the fiber has a scan viscosity of from 300 to 440 ml/g.
6) Lyocell fiber according to any one of the preceding embodiments, having a porous core layer and a pore size of the surface layer of above 5 nm.
7) Lyocell fiber according to any one of the preceding embodiments, having a crystallinity of 35% or less.
8) Lyocell fiber according to any one of the preceding embodiments, with a xylan content of 6 wt.-% or more, preferably 8 wt.-% or more, more preferably 12 wt.-% or more.
9) Lyocell fiber according to any one of the preceding embodiments, with a mannan content of 1 wt.-% or less, preferably 0.2 wt.-% or less, more preferably 0.1 wt.-% or less.
10) Lyocell fiber according to any one of embodiments 1 to 9, with a mannan content of 3 wt.-% or more, preferably 5 wt.-% or more.
11) Method for producing a lyocell fiber according to any one of the preceding embodiments comprising the following steps:
    a) Manufacture of a spinning solution containing 10 to 20 wt.-% cellulose with a hemicelluloses content of 7 wt.-% or more,
    b) Extrusion of the spinning solution through extrusion nozzles to obtain filaments,
    c) Initial coagulation of the filaments via a spin bath containing a coagulation liquor with a concentration of tertiary amine oxide of 20% or less;
    d) Washing the filaments; and
    e) After-treatment (f.e. washing, cutting, drying) to yield wet or dry filaments or staple/short cut fibers or other cellulosic embodiments.
12) Method according to embodiment 11, wherein the hemicellulose comprises a ratio of xylan to mannan hemicelluloses of from 125:1 to 1:3, such as 25:1 to 1:2.
13) Product, comprising the lyocell fiber according to any one of embodiments 1 to 9, or the fiber produced according to any one of embodiments 10 to 12.
14) Product according to embodiment 13, selected among non-woven fabrics and textiles.
15) Product according to embodiment 13 and/or 14, selected among tissues and wipes.

BRIEF DESCRIPTION OF THE FIGURES

FIG. 1 shows the fibrillation dynamics of a fiber in accordance with the present invention in comparison with a standard fiber and a standard fiber subjected to chemical fibrillation.

FIG. 2 shows a comparison of the fiber in accordance with the present invention as compared to a standard lyocell fiber after fluorescent staining. The fiber in accordance with the present invention shows an even distribution of the stained areas throughout the entire cross section of the fiber, whereas the standard lyocell fiber displays only a superficial staining of the outer sheath part of the fiber.

FIGS. 3 and 4 display the results of enzymatic peeling evaluations while FIGS. 5 to 7 show the results of degradation tests in soil.

DETAILED DESCRIPTION OF THE INVENTION

As defined in claim 1 the fiber in accordance with the present invention is a lyocell fiber with a WRV rendering the fiber suitable as viscose replacement.

In embodiments the fiber of the present invention shows a novel structure of the cross section, as compared to standard lyocell fibers. While the three-layer structure known from standard lyocell fibers is maintained, at least the inner core layer shows an increased porosity, as compared with standard lyocell fibers. In embodiments also the surface layer may be less thick and/or the pore size, which is typically for standard lyocell fibers in the range of from 2 to 5 nm, may be larger.

In further embodiments, which may be considered in combination with the embodiments mentioned above as well as embodiments mentioned below, the fibers in accordance with the present invention are lyocell fibers with enhanced fibrillation tendencies, which are produced without any chemical pre-treatment. The chemical pre-treatment step weakens the fiber properties (working capacity) on the one hand and adds cost to the fiber production on the other hand.

Additionally, the fiber in accordance with the present invention shows well-balanced fibrillation dynamics between standard lyocell fibers and fast fibrillated fibers obtained from with additional chemical pre-treatments. Accordingly, in embodiments the lyocell fiber in accordance with the present invention avoids the need for chemical pretreatment whilst achieving fast fibrillation.

Standard lyocell fibers are currently commercially produced from high quality wood pulps with high a-cellulose content and low non-cellulose contents such as hemicelluloses. Commercially available lyocell fibers such as TENCELT" fibers produced from Lenzing AG, show excellent fiber properties for non-wovens and textile applications.

As mentioned in the patents referred to above, if a high fibrillation tendency is required these lyocell fibers are chemically pre-treated using agents such as mineral acids or bleaching reagents. By this chemical treatment the fiber properties are weakened drastically and the working capacity decreases.

The lyocell process is well known in the art and relates to a direct dissolution process of cellulose wood pulp or other cellulose-based feedstock in a polar solvent (for example N-methylmorpholine N-oxide [NMMO, NMO] or ionic liquids). Commercially, the technology is used to produce a family of cellulose staple fibers (commercially available from Lenzing AG, Lenzing, Austria under the trademark TENCEL® or TENCEL™) which are widely used in the textile and nonwoven industry. Other cellulose bodies from lyocell technology have also been produced.

The fibers in accordance with the present invention were produced on a semi-commercial pilot plant (~1 kt/a) and a complete, commercial-like after-treatment of the fiber. A straightforward scale-up from this production unit to a commercial unit (>30 kt/a) is feasible and reliable.

According to this method the solution of cellulose is extruded in a so called dry-wet-spinning process by means of a forming tool and the molded solution is guided for example over an air gap into a precipitation bath, where the molded body is obtained by precipitation of the cellulose. The molding is washed and optionally dried after further treatment steps.

Such lyocell fibers are well known in the art and the general methodology to produce and analyze same is for example disclosed in U.S. Pat. No. 4,246,221 and in the BISFA (The International Bureau for the Standardization of Man-Made Fibers) publication "*Terminology of Man-Made Fibers*", 2009 edition. Both references are included herewith in their entirety by reference.

The term lyocell fiber as employed herein defines a fiber obtained by this process, as it has been found that fibers in accordance with the present invention differ greatly from fibers for example obtained from a meltblown process, even if using a direct dissolution process of cellulose wood pulp or other cellulose-based feedstock in a polar solvent (for example N-methylmorpholine N-oxide [NMMO, NMO] or ionic liquids) in order to produce the starting material. At the same time the fibers in accordance with the present invention also differ from other types of cellulose based fibers, such as viscose fibers.

The term hemicelluloses as employed herein refers to materials known to the skilled person which are present in wood and other cellulosic raw material such as annual plants, i.e. the raw material from which cellulose typically is obtained. Hemicelluloses are present in wood and other plants in form of branched short chain polysaccharides built up by pentoses and/or hexoses (C5 and/or C6-sugar units). The main building blocks are mannose, xylose, glucose, rhamnose and galactose. The backbone of the polysaccharides can consist of only one unit (f.e. xylan) or of two or more units (e.g. mannan). Side chains consist of arabinose groups, acetyl groups, galactose groups and 0-acetyl groups as well as 4-0-methylglucuronic acid groups. The exact hemicellulose structure varies significantly within wood species. Due to the presence of sidechains hemicelluloses show much lower crystallinity compared to cellulose. It is well known that mannan predominantly associates with cellulose and xylan with lignin. In sum, hemicelluloses influence the hydrophilicity, the accessibility and degradation behavior of the cellulose-lignin aggregate. During processing of wood and pulp, side chains are cleaved off and the degree of polymerization is decreased. The term hemicelluloses as known by the skilled person and as employed herein comprises hemicelluloses in its native state, hemicelluloses degraded by ordinary processing and hemicelluloses chemically modified by special process steps (e. g. derivatization) as well as short chain celluloses and other short chain polysaccharides with a degree of polymerization (DP) of up to 500.

The present invention overcomes the shortcomings of the state of the art by providing lyocell fibers as described herein.

Preferably these are produced from hemicellulose-rich pulps with a hemicelluloses content of at least 7 wt.-%. As mentioned above, the hemicelluloses content in the fibers of the present invention accordingly generally is higher, as compared to standard lyocell fibers. Suitable contents are 7 wt.-% or more and up to 30 wt.-%, or higher as further explained below. Contrary to the disclosure in the prior art discussed above, such high hemicellulose content surprisingly, for lyocell fibers, gives rise to a combination of properties rendering the fibers suitable as viscose replacement. In embodiments, properties such as an increased tendency to fibrillate are provided as well, as well as improved degradation behavior. Accordingly, the present invention surprisingly achieves the tasks as outlined above while using a cellulose based raw material with a higher hemicelluloses content, as compared for standard lyocell fibers.

The pulps preferably employed in the present invention do show as outlined herein a high content of hemicelluloses. Compared with the standard low hemicellulose content pulp employed for the preparation of standard lyocell fibers the preferred pulps employed in accordance with the present invention do show also other differences, which are outlined below.

Compared with standard pulps the pulps as employed herein display a more fluffy appearance, which results after milling (during preparation of starting materials for the formation of spinning solutions for the lyocell process), in the presence of a high proportion of larger particles. As a result, the bulk density is much lower, compared with standard pulps having a low hemicellulose content. This low bulk density requires adaptions in the dosage parameters (f.e. dosage from at least 2 storage devices). In addition, the pulps employed in accordance with the present invention are more difficult to impregnate with NMMO. This can be seen by evaluating the impregnating behavior according to the Cobb evaluation. While standard pulps do show a Cobb value of typically more than 2.8 g/g (determined according to DIN EN ISO 535 with the adaptation of employing an aqueous solution of 78% NMMO at 75° C. with an impregnation time of 2 minutes), the pulps employed in the present invention do show Cobb values of about 2.3 g/g. This requires an adaptation during spinning solution preparation, such as increased dissolution time (f.e. explained in WO 9428214 and WO 9633934) and/or temperature and/or increased searing during dissolution (f.e. W09633221, W09805702 and WO 9428217). This ensures the preparation of a spinning solution enabling the use of the pulps described herein in standard lyocell spinning processes.

In one preferred embodiment of the present invention the pulp employed for the preparation of the lyocell products, preferably fibers, as described herein, has a scan viscosity in the range of from 300-440 ml/g, especially 320-420 ml/g, more preferably 320 to 400 ml/g. The scan viscosity is determined in accordance with SCAN-CM 15:99 in a cupriethylenediamine solution, a methodology which is known to the skilled person and which can be carried out on commercially available devices, such as the device Auto PuIpIVA PSLRheotek available from psl-rheotek. The scan viscosity is an important parameter influencing in particular processing of the pulp to prepare spinning solutions. Even if two pulps seem to be of great similarity as raw material for the lyocell-process, different scan viscosities will lead to completely different behavior different during processing. In a direct solvent spun process like the lyocell-process the pulp is dissolved in NMMO as such. No ripening step exists comparable to the viscose process where the degree of polymerization of the cellulose is adjusted to the needs of the process. Therefore, the specifications for the viscosity of the raw material pulp typically are within a small range. Otherwise, problems during production may arise. In accordance with the present invention it has been found to be advantageous if the pulp viscosity is as defined above. Lower viscosities compromise mechanical properties of the lyocell products. Higher viscosities in particular may lead to the viscosity of the spinning dope being higher and therefore, spinning will be slower. With a slower spinning velocity, lower draw ratios will be attained, which significantly alters the fiber structure and its properties (Carbohydrate Polymers 2018, 181, 893-901; Structural analysis of lon-cell-F fibers from birch wood, Shirin Asaadia; Michael Hummel; Patrik Ahvenainen; Marta Gubitosic; Ulf Olsson, Herbert Sixta). This will require process adaptations and will lead to a decrease in mill capacity. Employing pulps with the viscosities as defined here enables smooth processing and production of high-quality products.

The pulp enabling the preparation of the fibers in accordance with the present invention preferably shows a ratio of C5/xylan to C6/mannan of from 125:1 to 1:3, preferably in the range of 25:1 to 1:2.

The hemicellulose content, independent or in combination with the above disclosed ratio, may be 7 wt.-% or more, preferable 10 wt.-% or more or 13 or 14 wt.-% or more and in embodiments up to 25 wt.-% or even 30 wt.-%. In embodiments the xylan content is 5 wt.-% or more, such as 8 wt.-% or more, and in embodiments 10 wt.-% or more. In embodiments, either in isolation or in combination with the above-mentioned hemicelluloses and/or xylan contents, the mannan content is 3 wt.-% or more, such as 5 wt.-% or more. In other embodiments the mannan content, preferably in combination with a high xylan content as defined above, may be 1 wt.-% or less, such as 0.2 wt.-% or 0.1 wt.-% or less.

The content of hemicelluloses in the pulps—which can also be a mixture of different pulps (as long as the essential requirements are met)—may be from 7 wt.-% up to 50 wt.-%, such as from 5 to 25, preferred 10 to 15 wt.-%. The hemicellulose content may be adjusted according to procedures known in the art. The hemicellulose may be the hemicelluloses originating from the wood from which the pulp is obtained, it is however also possible to add individual hemicelluloses depending on the desired fiber properties from other sources to high purity cellulose with a low original hemicellulose content. The addition of individual hemicelluloses may also be employed to adjust the composition of the hemicelluloses content, for example to adjust the ratio of hexoses to pentoses. In a preferred embodiment, in isolation or any combination with at least one of the preceding embodiments described herein, the cellulose content in the pulp is in the range of from 95 wt.-% to 50 wt.-%, preferably from 93 wt.-% to 60 wt.-%, such as from 85 wt.-% to 70 wt.-%.

In embodiment the pulp employed for preparing the fibers in accordance with the present invention may have a cellulose content of from 85 to 70 wt-%, a xylan content of 5 wt.-% or more and a mannan content of 3, preferably 5 wt.-% or more. Another embodiment is a pulp with a cellulose content of from 85 to 70 wt.-%, a xylan content of 8 wt.-% or more and a mannan content of 1 wt.-% or less, preferably 0.2 or 0.1 wt.-% or less.

The hemicelluloses contained in the pulp used for preparing the fibers in accordance with the present invention may have varying compositions, in particular regarding the content of pentoses and hexoses. In embodiments the content of pentoses in the hemicellulose-rich pulp employed in the present invention is higher that the hexose content. Preferably the fiber in accordance with the present invention shows a ratio of C5/xylan to C6/mannan of from 125:1 to 1:3, such as from 75:1 to 1:2, preferably in the range of 25:1 to 1:2, and in embodiments from 10:1 to 1:1. As regards the xylan and/or mannan content the above provided embodiments described in relation with the pulp are applicable also for the fiber as such.

As previously outlined, the task and object mentioned above is solved in accordance with the present invention by lyocell fibers with the properties mentioned above. The fibers in accordance with the present invention show, in embodiments due to the specific structure, improved properties, which may include increased enzymatic peelability, improved biological disintegration, as well as improved fibrillation properties and the above mentioned WRV. In other embodiments, which may be considered in combination with all embodiments mentioned herein, the WRV may be influenced by the crystallinity as well as by the structure of the fiber, in particular the porous core layer.

Standard lyocell fibers are currently commercially produced from high quality wood pulps with high a-cellulose content and low non-cellulose contents such as hemicelluloses. Commercially available lyocell fibers such as TENCELT" fibers produced from Lenzing AG, show excellent fiber properties for non-wovens and textile applications.

The present invention surprisingly is able to provide fibers with the unique properties and structure as described herein by using hemicellulose-rich pulps with a hemicellulose content of at least 7 wt.-%. Contrary to the disclosure in the prior art discussed above, such high hemicellulose content surprisingly, for lyocell fibers of the present invention, gives rise to an increased porosity of the core layer of the lyocell fiber structure, while having only minor effect on the mechanical properties of the fibers. Also, the WRV is increased as well as fibrillation tendencies. Accordingly, the present invention surprisingly achieves the tasks as outlined above while using a cellulose based raw material with a higher hemicelluloses content, as compared for standard lyocell fibers.

As already outlined above, Zhang et al (Polym. Engin. Sci. 2007, 47, 702-706) describe fibers with high hemicellulose contents. Likewise, meltblown fibers with high hemicelluloses contents are known from the prior art discussed above. However, contrary to the results as reported in the prior art the present invention provides fibers with completely different properties as outlined above. One possible explanation for these contrasting findings may be the fact that the fibers in accordance with the present invention are fibers produced using large scale production equipment employing a lyocell spinning process, while the fibers described in the prior art are either produced with lab equipment not allowing the production of lyocell fibers in commercial quality (as for example drawing ratios, production velocities and after-treatment do not reflect scale-up qualities) or produced using meltblowing techniques. The fibers, not being produced in with sufficient drawing and inadequate after-treatment therefore show different structure and properties compared to the fibers produced at production scale at titers reflecting market applications.

The fibers in accordance with the present invention typically have a titer of 6.7 dtex or less, such as 2.2 dtex or less, such as 1.7 dtex, or even lower, such as 1.3 dtex or even lower, depending on the desired application. If the fiber is intended to be used in non-woven applications a titer of from 1.5 to 1.8 dtex typically is suitable while for textile applications lower titers such as from 0.9 to 1.7 dtex are suitable. Surprisingly the present invention enables the formation of fibers with the desired titers over the whole application range, from non-woven applications to textile applications. However, the present invention also covers fibers with much lower titers, with suitable lower limits for titers being 0.5 dtex or higher, such as 0.8 dtex or higher, and in embodiments 1.3 dtex or higher. These upper and lower values as disclosed here define ranges of from 0.5 to 9 dtex, and including all further ranges formed by combining any one of the upper values with any one of the lower values.

The fiber in accordance with the present invention may be prepared using lyocell technology employing a solution of cellulose and a spinning process employing a precipitation bath according to standard lyocell processes, known to the skilled person. As outlined above, the present invention provides fibers which are produced with large scale processing methods, as this enhances the properties and structures associated with the present invention.

The fiber in accordance with the present invention preferably shows a reduced crystallinity, preferably of 40% or less. The fiber in accordance with the present invention preferably shows a WRV of 70% or more, more preferably 75% or more. Illustrative ranges of WRV of the fibers of the present invention, in particular in combination with the crystallinity values described herein, are from 72% to 90%, such as from 75% to 85%. The fiber in accordance with the present invention does not show any sulfuric smell so that olfactoric drawbacks of viscose fibers are overcome, while properties such as WRV and working capacity enable the use of the fibers of the present invention as viscose replacement fibers.

The fiber in accordance with the present invention, in isolation or in any combination with features outlined above as preferred for the claimed fiber, has a crystallinity of 40% or less, preferably 39% or less. In particular, fibers to be employed for non-woven applications do show preferably a low crystallinity of for example from 39 to 30%, such as from 38 to 33%. The present invention however is not limited to these exemplary crystallinity values. As explained above, in comparison to standard lyocell fibers the fibers in accordance with the present invention do show a reduced crystallinity of 40% or less.

The fiber in accordance with the present invention shows in embodiments a novel type of distribution of the hemicelluloses over the cross section of the fiber. While for standard lyocell fibers the hemicelluloses are concentrated within the surface region of the fiber; the fibers in accordance with the present invention do show an even distribution of the hemicelluloses over the entire cross section of the fiber. Such a distribution enhances the functionality of the fiber, as hemicelluloses increase for example binding properties towards other additives with a matching chemical reactivity. In addition, the even distribution of the hemicelluloses may also contribute towards stabilizing the novel structure of the fibers in accordance with the present invention, comprising larger pores in the surface layer and a porous core layer. This novel structure enhances uptake as well as retention of other molecules, such as dyes and also contributes towards a faster degradation, in particular biological (enzymatic) degradation/disintegration.

The fibers in accordance with the present invention may be employed for a variety of applications, such as the production of non-woven fabrics, but also textiles. The fibers in accordance with the present invention may by employed as the only fiber of a desired product or they may be mixed with other types of fibers. The mixing ratio can depend from the desired end use. If for example a non-woven or textile product with enhanced fibrillation and water retention is desired the fibers in accordance with the present invention may be present in a higher amount, relative to other fibers according to the prior art, in order to secure the desired properties, while in other applications a lower relative amount of fibers of the present invention may be sufficient. In other applications, for example when an improved degradation behavior, the content of the fibers of the present invention may be high, for example in an admixture with standard lyocell fibers.

As far as the present application refers to parameters, such as crystallinity, scan viscosity etc., it is to be understood that same are determined as outlined herein, in the general part of the description and/or as outlined in the following examples. In this regard it is to be understood that the parameter values and ranges as defined herein in relation to fibers refer to properties determined with fibers derived from pulp and containing only additives, such as processing aids typically added to the dope as well as other additives, such as matting agents ($TiO_2$, which often is added in amounts of 0.75 wt.-%), in a total amount of up to 1 wt.-% (based on fiber weight). The unique and particular properties as reported herein are properties of the fibers as such, and not properties obtained by addition of particular additives and/or post spinning treatments (such as fibrillation improving treatments etc.).

However, it is clear to the average skilled person that the fibers as disclosed and claimed herein may comprise additives, such as inorganic fillers etc. in usual amounts as long as the presence of these additives has no detrimental effect on dope preparation and spinning operation. The type of such additives as well as the respective addition amounts are known to the skilled person.

EXAMPLES

Example 1: Lyocell Fiber Production and Analysis 3 different fibers were produced using 3 different types of pulp with different hemicellulose contents (table 4). The lyocell fibers were produced according to W093/19230 dissolving the pulps in NMMO and spinning them over an air-gap into a precipitation bath to receive fibers with titers from 1.3 dtex to 2.2 dtex, without and with matting agent (0.75% TiO2).

TABLE 1

Sugar contents of the different pulps for the lyocell fiber production

| sugar [% ATS] | reference pulp | hemi-rich pulp 1 | hemi-rich pulp 2 |
|---|---|---|---|
| Glucan | 95.5 | 82.2 | 82.3 |
| Xylan | 2.3 | 8.3 | 14 |
| Mannan | 0.2 | 5.7 | <0.2 |
| Arabinan | <0.1 | 0.3 | <0.1 |
| Rhaman | <0.1 | <0.1 | <0.1 |
| Galactan | <0.1 | 0.2 | <0.1 |

The fiber properties of the lyocell fibers produced were analyzed. The results are summarized in table 2. Fiber 1 is produced from hemi-rich pulp 1 and fiber 2 from hemi-rich pulp 2. The standard lyocell (CLY) fibers are produced from the standard lyocell reference pulp. Bright indicates a textile fiber without matting agent, whereas the dull fibers contain the matting agent identified above.

TABLE 2

Fiber properties (working capacity determined in accordance with BISFA definitions)

| fiber type | Titer [dtex] | working capacity [cNitex* %] | FFk [cNitex] | FDk (%) |
|---|---|---|---|---|
| 1.3 dtex/38 mm fiber 1 bright | 1.33 | 410 | 31 | 13.2 |
| 1.3 dtex/38 mm CLY standard bright | 1.28 | 491 | 35.7 | 13.8 |
| 1.7 dtex/38 mm fiber 1 bright | 1.69 | 380 | 30.4 | 12.5 |
| 1.7 dtex/38 mm CLY standard bright | 1.65 | 571 | 38.6 | 14.8 |
| 2.2 dtex/38 mm fiber 1 bright | 2.12 | 339 | 28.2 | 12.1 |
| 2.2 dtex/38 mm CLY standard bright | 2.14 | 559 | 41.7 | 13.4 |
| 1.7 dtex/38 mm fiber 1 dull | 1.67 | 333 | 28.7 | 11.6 |
| 1.7 dtex/38 mm CLY standard dull | 1.71 | 384 | 32.1 | 11.9 |
| 1.7 dtex/38 mm fiber 2 dull | 1.72 | 315 | 27.6 | 11.4 |
| 1.7 dtex/38 mm CLY standard dull (pulp 2) | 1.75 | 386 | 30.6 | 12.6 |

The displayed results show that the fibers in accordance with the present invention may be prepared over the commercially relevant range of fiber titers, while maintaining sufficient mechanical properties, in particular working capacity, to render these fibers suitable as viscose replacement fibers.

Example 2: Crystallinity Measurements

Crystallinities of the fibers of Example 1 are measured using a FT/IR with a Bruker MultiRAM FT-Raman spectrometer with a Nd-Yag-laser at 1064 nm and 500 mW. The fibers are pressed into pellets for a smooth surface. Fourfold determination with a spectral resolution of 4 $cm^{-1}$ with 100 scans respectively. Evaluation of the measurements was done using a chemometric method (calibration with WAXS-data).

It can be seen that the crystallinities of the fibers of the present invention (fiber 1 and 2) decrease by 16 and 15% respectively compared to the standard CLY fibers.

TABLE 3

Crystallinities of the different lyocell fibers

| fiber type roi | crystallinity |
|---|---|
| 1.3 dtex/38 mm CLY standard bright | 44 |
| 1.3 dtex/40 mm viscose standard bright | 29 |
| 1.3 dtex/38 mm fiber 1 bright | 37 |
| 1.7 dtex/38 mm CLY standard dull | 47 |
| 1.7 dtex/40 mm viscose standard dull | 34 |
| 1.7 dtex/38 mm fiber 1 dull | 40 |
| 1.7 dtex/38 mm fiber 2 dull | 39 |

Example 3: WRV Determination (According to DIN 53814 (1974))

For determining the water retention value, a defined quantity of dry fibers is introduced into special centrifuge tubes (with an outlet for the water). The fibers are allowed to swell in deionized water for 5 minutes. Then they are centrifuged at 3000 rpm for 15 minutes, whereupon the moist cellulose is weighed right away. The moist cellulose is dried for 4 hours at 105° C., whereupon the dry weight is determined. The WRV is calculated using the following formula:

(mf−mt)

$$WRV[\%] = \frac{(mf - mt)}{mt * 100} (m_f = \text{moist mass}, m_t = \text{dry mass})$$

The water retention value (WRV) is a measured value that indicates how much water of a moisture penetrated sample is retained after centrifuging. The water retention value is expressed as a percentage relative to the dry weight of the sample.

In table 4 the water retention values of the fibers of the present invention (fiber 1 and 2) compared to the reference fibers are listed and an increase of the WRV by 19% and 26% respectively compared to standard CLY fibers can be observed.

TABLE 4

WRV of the different lyocell fibers

| fiber type | WRV [%] |
|---|---|
| 1.3 dtex/38 mm CLY standard bright | 69.6 |
| 1.3 dtex/40 mm viscose standard bright | 89.9 |
| 1.3 dtex/38 mm fiber 1 bright | 82.8 |
| 1.7 dtex/38 mm CLY standard dull | 65.3 |
| 1.7 dtex/38 mm fiber 1 dull | 82.5 |
| 1.7 dtex/38 mm fiber 2 dull | 78.0 |

These results prove that the fibers in accordance with the present invention display a WRV rendering these fibers suitable as viscose replacement fibers.

Example 4: Fibrillations Tendencies

In table 5 the CSF (analyzed according to TAPPI Standard T227 om-94) values of different fiber types are compared. The CSF values after 8 min of mixing are shown.

The CSF values show a significantly increased fibrillation tendency of the invented fibers.

TABLE 5

Comparison of CSF values of different fibers after 8 min of mixing time.

| fiber type | CSF [ml] |
|---|---|
| 1.3 dtex/38 mm CLY standard bright | 405 |
| 1.3 dtex/38 mm fiber 1 bright | 276 |
| 1.7 dtex/38 mm CLY standard dull | 285 |
| 1.7 dtex/38 mm fiber 1 dull | 115 |

The results show a higher fibrillation tendency for the fibers of the present invention, as compared with standard lyocell fibers.

Example 5: Comparison of Fibrillation Dynamics 3 different fiber types were compared:

The standard 1.7 dtex/4 mm lyocell fibers are commercially available as TENCEL™ fibers from Lenzing AG ("lyocell standard").

Lyocell fibers subjected to a chemical pre-treatment ("lyocell chemical fibrillation") were produced as described in AT 515693. A fiber tow with single titers of 1.7 dtex was impregnated with diluted sulfuric acid at room temperature with a liquor ratio 1:10 and afterwards pressed to −200% moisture. After-treatment of the fiber tow in a steamer for −10 min allows application of water vapor under pressure. The fiber bundle is washed acid-free, a soft-finish is applied, and the fibers are dried. The dried fiber tow is cut into 4 mm shortcut fibers subsequently ending up with 1.7 dtex/4 mm "lyocell chemical fibrillation" fibers.

Lyocell fibers of the present invention were produced from the hemicellulose-rich pulp 1 from example 1 with a hemicelluloses content of >10% (xylan, mannan, arabinan, . . . ), yielding after post-spinning treatment 1.7 dtex/4 mm fibers.

The 3 different fiber types were refined in an Andritz Laboratory plant 12-1C plate refiner (NFB, SO1-218238) at a starting concentration of 6 g/l, 1400 rpm and 172 l/min flow rate. The gap was fixed at 1 mm.

The refining results are illustrated in FIG. 1. It can be seen that lyocell fibers of the present invention, designated lyocell increased fibrillation and lyocell chemical fibrillation fibers fibrillate at a significant higher rate compared to lyocell standard fiber, meaning a decrease in time- and energy effort. The lyocell increased fibrillation fiber however showed a slower increase in fibrillation.

Example 6: Comparison of Fluorescent Staining

The fibers of Example 1 fiber 1 bright (1.3 dtex/38 mm), CLY standard bright (1.3 dtex/38 mm) as well as standard viscose standard bright fibers (1.3 dtex/38 mm) were subjected to staining with Uvitex BHT according to the method of Abu-Rous (J. Appl. Polym. Sci., 2007, 106, 2083-2091). The fibers obtained were evaluated after different intervals of immersion in the dye solution, at periods of from 5 min to 24 h. Due to the big size of the dye molecules the penetration is restricted to areas with bigger pore volumes.

Conclusions can be drawn from the extend of dye penetration about the porous structure of the fiber cross section. The intensity of the color gives indications about the number of pores and voids, their size and chemical binding of the dye molecules to the inner surface of the fiber pores. Chemical binding is mainly attributed to hemicelluloses and non-crystalline regions. Surprisingly, the fibers in accordance with the present invention showed a fast and complete staining of the entire cross section of the fiber as shown in FIG. 2. The fiber is more easily penetrated indicating an increased accessibility due to a bigger pore size and number in the new fibers, a lower crystallinity as shown in Example 2 and a higher hemicellulose content over the whole fiber cross section as shown in Example 7. The viscose fibers showed an uptake of the dye up to 3 h, thereafter no further uptake of dye was observed.

At the same time, the dye uptake was restricted to the outer regions of the viscose fiber. The standard lyocell fibers showed a similar behavior, although the staining was somewhat faster and more intense, compared to the viscose fibers. However, the staining was restricted to the shell and middle layer of the fiber with no staining of the dense and compact core layer of the standard lyocell fibers. The results are also summarized in Table 6 and FIG. 2.

TABLE 6

Comparison of time and extend of staining

| Property | Viscose standard bright | CLY standard bright | fiber 1 |
|---|---|---|---|
| Velocity of staining | Slow | Middle | Fast |
| Staining extend | Only outer regions | Shell and middle layer | Entire cross section |
| Intensity of coloring | Slight | Intense | Intense |

Example 7: Enzymatic Peeling

The lyocell fibers according to the present invention were subjected to an enzymatic peeling test according to Sjoberg et al (Biomacromolecules 2005, 6, 3146-3151). A viscose fiber with an enhanced xylan content of 7.5% was chosen for comparison from the paper by Schild et al (Cellulose 2014, 21, 3031-3039). The test enables the generation of data concerning the hemicellulose distribution over the cross section of fibers, in particular xylan (by HPLC determination) including information relating to different densities and structures of layers (as denser layers show a slower response as well as layers with smaller pore sizes).

The standard lyocell fibers (1.3 dtex/38 mm bright) as well as the xylan enriched viscose fibers (1.3 dtex/40 mm bright) showed a slow peeling rate (FIG. 4). This effect is even more pronounced for prolonged peeling times due to the denser cores. At the same time, the xylan liberation determined corresponds to fibers with high hemicellulose content at the surface of the fiber and a sharp concentration decrease towards the core (FIG. 3). Contrary thereto, the fibers in accordance with the present invention show a peeling behavior corresponding to a fiber structure with an even distribution of the hemicellulose content over the entire cross section.

Additionally, the peeling is much faster. This is even more astonishing and completely new as this phenomenon could not be achieved with xylan enriched viscose fibers. Due to the faster peeling rate it can be concluded that the new fibers have more porous core and surface layers with increased pore sizes and numbers and a homogenous distribution of the xylan over the whole fiber cross section.

Example 8: Disintegration in Soil 3 different fiber types were used to test the different disintegration behavior—1.7 dtex/38 mm fiber 1 dull, 1.7 dtex/38 mm CLY standard dull and 1.7 dtex/40 mm viscose standard dull.

The fibers were subsequently converted into 50 gsm wipes using spunlacing-technology.

Disintegration is qualitatively evaluated during 8 weeks (the test normally lasts 12 weeks, but after the material completely disappeared after 8 weeks, the test was stopped) of composting, simulating industrial composting conditions.

The test materials were put in slide frames, mixed with biowaste and composted in a 200 liter composting bin.

The test is considered valid if the maximum temperature during the composting (industrial composition requirements) is above 60° C. and below 75° C. Moreover, the daily temperature should be above 60° C. during 1 week and above 40° C. during at least 4 consecutive weeks.

The requirements were largely fulfilled. After start-up the temperature increased almost immediately till above 60° C. and stayed below 75° C., except shortly after 5 days with a maximum value of 78.0° C. However, immediate action was undertaken when the temperature exceeded the limit and lower temperatures were established. The temperature remained above 60° C. during at least 1 week. After 1.1 weeks of composting the bin was placed in an incubation room at 45° C. to ensure a temperature above 40° C. Elevated temperatures during the composting process were mainly due to the turning of the content of the bin, during which air channels and fungal flocks were broken up and moisture, microbiota and substrate were divided evenly. As such optimal composting conditions were re-established, resulting in a higher activity and a temperature increase. The temperature remained above 40° C. during 4 consecutive weeks.

The mixture in the bin is regularly turned manually during which the disintegration of the test items is visually monitored. A visual presentation of the evolution of the disintegration of the test materials in slide frames during the composting process is shown in FIG. 5 up to FIG. 7. An overview of the visual observations made during the test is given in Table 7.

It can be clearly seen from the figures that fiber 1 in accordance with the present invention disintegrates much faster compared to standard lyocell. The disintegration after 4 weeks is comparable with the viscose test sample—after 2 weeks large holes can be observed at the fiber 1 sample, whereas the viscose sample shows only small tears and holes and the lyocell sample is still intact.

TABLE 7

Overview of the visual observations during the test

| Test item | 1 week | 2 weeks | 3 weeks | 4 weeks | 6 weeks | 8 weeks |
|---|---|---|---|---|---|---|
| fiber 1 | Intact - brown color | Large holes - brown color | A border of test material remained present - brown color | A few tiny pieces remained present - dark brown color | All slide frames were completely empty. | Test was stopped. |
| viscose | Intact - brown color | Small tears and holes - brown color - fungal growth | A small border of test material remained present - brown color | A few tiny pieces remained present - dark brown color | All slide frames were completely empty | Test was stopped |
| lyocell | Intact - brown color | Mainly intact - brown color | Tears and holes - brown color | A few tiny pieces remained present - dark brown color | All slide frames were completely empty | Test was stopped |

The invention claimed is:

1. A lyocell fiber with a water retention value (WRV) of at least 70% and a crystallinity of 40% or less, wherein hemicellulose of the lyocell fiber has a ratio of xylan to mannan hemicelluloses of from 125:1 to 1:3.

2. The lyocell fiber according to claim 1, having a titer of 6.7 dtex or less.

3. The lyocell fiber according to claim 2, having a titer of 2.2 dtex or less.

4. The lyocell fiber according to claim 3, having a titer 1.3 dtex or less.

5. The lyocell fiber according to claim 1, produced from a pulp having a hemicellulose content of 7 wt.-% or more and 25 wt.-% or less.

6. The lyocell fiber according to claim 1, having a porous core layer and a pore size of the surface layer of above 5 nm.

7. The lyocell fiber according to claim 1, wherein the pulp employed for preparing the fiber has a scan viscosity of from 300 to 440 ml/g.

8. The lyocell fiber according to claim 1, having a crystallinity of 35% or less.

9. The lyocell fiber according to claim 1, with a xylan content of 6 wt.-%.

10. The lyocell fiber according to claim 9, with a xylan content of 8 wt.-% or more.

11. The lyocell fiber according to claim 10, with a xylan content of 12 wt.-% or more.

12. The lyocell fiber according to claim 1, with a mannan content of 1 wt.-% or less.

13. The lyocell fiber according to claim 12, with a mannan content of 0.2 wt.-% or less.

14. The lyocell fiber according to claim 13, with a mannan content of 0.1 wt.-% or less.

15. The lyocell fiber according to claim 1, with a mannan content of 3 wt.-% or more.

16. The lyocell fiber according to claim 15, with a mannan content of 5 wt.-% or more.

17. A method for producing a lyocell fiber according to claim 1 comprising the following steps:

a) manufacturing—a spinning solution containing 10 to 20 wt.-% cellulose with a hemicelluloses content of 7 wt.-% or more, b) extruding the spinning solution through extrusion nozzles to obtain filaments, c) initially coagulating the filaments via a spin bath containing a coagulation liquor with a concentration of tertiary amine oxide of 20% or less;

d) washing the filaments; and e) after-treating to yield wet or dry filaments or staple/short cut fibers or other cellulosic embodiments.

18. A product comprising the lyocell fiber produced according to claim 17.

19. The method according to claim 17, wherein the step e) includes washing, cutting, and/or drying.

20. A product comprising the lyocell fiber according to claim 1.

21. The product according to claim 20, selected among non-woven fabrics and textiles.

22. The product according to claim 20, selected among tissues and wipes.

* * * * *